US008388381B2

(12) United States Patent
Borgstrom et al.

(10) Patent No.: US 8,388,381 B2
(45) Date of Patent: Mar. 5, 2013

(54) VISIBLE OPEN FOR SWITCHGEAR ASSEMBLY

(75) Inventors: Alan D. Borgstrom, Hackettstown, NJ (US); James Cole, Oxford, NJ (US)

(73) Assignee: Thomas & Betts International, Inc., Wilmington, DE (US)

( * ) Notice: Subject to any disclaimer, the term of this patent is extended or adjusted under 35 U.S.C. 154(b) by 0 days.

(21) Appl. No.: 13/162,622

(22) Filed: Jun. 17, 2011

(65) Prior Publication Data

US 2012/0021650 A1 Jan. 26, 2012

Related U.S. Application Data

(60) Provisional application No. 61/366,242, filed on Jul. 21, 2010.

(51) Int. Cl.
*H01R 24/00* (2011.01)

(52) U.S. Cl. ..... 439/626

(58) Field of Classification Search ..... 439/626, 439/181, 483
See application file for complete search history.

(56) References Cited

U.S. PATENT DOCUMENTS

| | | | | |
|---|---|---|---|---|
| 2,870,298 | A | 1/1959 | Schwager | |
| 2,984,816 | A * | 5/1961 | Wallace | 439/277 |
| 3,399,286 | A | 8/1968 | Kerr | |
| 3,471,669 | A | 10/1969 | Curtis | |
| 3,812,314 | A | 5/1974 | Nonken | |
| 3,932,717 | A | 1/1976 | Dike et al. | |
| 3,955,167 | A | 5/1976 | Kumbera | |
| 3,956,721 | A | 5/1976 | Link | |
| 4,124,790 | A | 11/1978 | Kumbera et al. | |
| 4,150,270 | A | 4/1979 | Zunick | |
| 4,202,591 | A | 5/1980 | Borgstrom | |
| 4,220,942 | A | 9/1980 | Meister et al. | |
| 4,249,050 | A | 2/1981 | Okumura | |
| 4,256,938 | A | 3/1981 | Efinger et al. | |
| 4,316,646 | A | 2/1982 | Siebens | |
| 4,323,874 | A | 4/1982 | Link | |
| 4,484,046 | A | 11/1984 | Neuhouser | |
| 4,568,804 | A | 2/1986 | Luehring | |
| 4,596,906 | A | 6/1986 | Chabala et al. | |
| 4,600,260 | A | 7/1986 | Stepniak et al. | |
| 4,645,888 | A | 2/1987 | Barkan et al. | |
| 4,799,895 | A | 1/1989 | Borgstrom | |
| 4,865,559 | A | 9/1989 | Clabburn | |

(Continued)

FOREIGN PATENT DOCUMENTS

WO 03096504 A1 11/2003

OTHER PUBLICATIONS

"Oil and Vacuum-Break Switches" Cooper Power Systems, Electrical Apparatus 260-20, Feb. 2002.

*Primary Examiner* — Amy Cohen Johnson
*Assistant Examiner* — Vladimir Imas
(74) *Attorney, Agent, or Firm* — Snyder, Clark, Lesch & Chung, LLP

(57) ABSTRACT

An electrical connector assembly may include a connector body having a conductor receiving end, a first link interface, a second link interface, a first connector end, and a visible open port between the first link interface and the second link interface. The first link interface may be conductively coupled to the conductor receiving end and the second link interface may be spaced axially from the first link interface and conductively coupled to the first connector end. The first link interface and the second link interface are configured to receive a link assembly therein. An insulative material may be positioned within the connector body axially between the first link interface and the second link interface. At least a portion of the insulative material may be visible through the visible open port.

20 Claims, 4 Drawing Sheets

U.S. PATENT DOCUMENTS 4,888,455 A 12/1989 Hanson
4,891,016 A * 1/1990 Luzzi et al. ..... 439/183
4,910,367 A 3/1990 Akers et al.
4,955,823 A 9/1990 Luzzi
5,089,931 A 2/1992 Thuries et al.
5,387,772 A 2/1995 Bestel
5,578,805 A 11/1996 Berger et al.
5,641,306 A 6/1997 Stepniak
5,667,060 A 9/1997 Luzzi
5,721,412 A 2/1998 Schifko et al.
5,790,041 A 8/1998 Lee
5,795,180 A 8/1998 Siebens
5,808,258 A 9/1998 Luzzi
5,864,942 A 2/1999 Luzzi
5,912,604 A 6/1999 Harvey et al.
5,917,167 A 6/1999 Bestel
5,957,712 A 9/1999 Stepniak
6,130,394 A 10/2000 Högl
6,168,447 B1 1/2001 Stepniak et al.
6,213,799 B1 4/2001 Jazowski et al.
6,319,051 B1 11/2001 Chang et al.
6,482,049 B1 11/2002 Swearingen
6,491,548 B2 12/2002 Stepniak et al.
6,504,103 B1 1/2003 Meyer et al.
6,561,841 B2 5/2003 Norwood et al.
6,585,531 B1 7/2003 Stepniak et al.
6,761,577 B1 7/2004 Koehler
6,825,426 B2 11/2004 Muench et al.
6,843,685 B1 1/2005 Borgstrom et al.
6,864,456 B1 3/2005 Banghard et al.
6,883,804 B2 4/2005 Cobb
6,939,151 B2 9/2005 Borgstrom et al.
6,984,791 B1 1/2006 Meyer et al.
7,144,279 B2 12/2006 Zahnen et al.
7,182,647 B2 2/2007 Muench et al.
7,262,362 B2 8/2007 Holaus et al.
7,397,012 B2 7/2008 Stepniak et al.
7,497,723 B2 3/2009 Brassell et al.
7,501,598 B2 3/2009 Stepniak et al.
7,503,785 B2 * 3/2009 Stepniak ..... 439/187
7,520,773 B2 4/2009 Siebens et al.
7,579,571 B2 8/2009 Siebens et al.
7,579,572 B2 8/2009 Stepniak et al.
7,648,376 B1 1/2010 Borgstrom
7,754,992 B2 7/2010 Stepniak et al.
8,128,423 B2 3/2012 Borgstrom et al.
2008/0311779 A1 12/2008 Brassell et al.
2009/0149064 A1 6/2009 Schuster et al.
2010/0022111 A1 1/2010 Borgstrom
2011/0189887 A1 * 8/2011 Borgstrom et al. ..... 439/488

* cited by examiner

VISIBLE OPEN FOR SWITCHGEAR ASSEMBLY

CROSS-REFERENCE TO RELATED APPLICATION

This application claims priority under 35. U.S.C. §119, based on U.S. Provisional Patent Application No. 61/366,242 filed Jul. 21, 2010, the disclosure of which is hereby incorporated by reference herein.

BACKGROUND OF THE INVENTION

The present invention relates to electrical cable connectors, such as loadbreak connectors and deadbreak connectors. More particularly, aspects described herein relate to an electrical cable connector, such as a power cable elbow or T-connector connected to electrical switchgear assembly.

High and medium voltage switch assemblies may include sub-atmospheric or vacuum type circuit interrupters, switches, or circuit breakers for use in electric power circuits and systems. Insulated vacuum bottles switches in such systems typically do not provide means for visual inspection of the contacts to confirm whether they are open (visible break) or closed. Non-vacuum bottle type switches previously used were designed to include contacts in a large gas or oil filled cabinet that allowed a glass window to be installed for viewing the contacts. However, with vacuum type switches, there is typically provided no means of directly viewing contacts in the vacuum bottles since the bottles are made of metal and ceramic non-transparent materials.

Typically, conventional insulated switches using vacuum technology are sealed inside the vacuum bottle and hidden from view. The voltage source and the load are connected to the switch, but the switch contacts are not visible. The only means for determining the status of the switch contacts is the position of a switch handle associated with the switch. If the linkage between the handle and the switch contacts is inoperative or defective, there is no positive indication that allows the operating personnel to accurately determine the position of the contacts. This can result in false readings, which can be very dangerous to anyone operating the switch or working on the lines/equipment.

DETAILED DESCRIPTION OF THE PREFERRED EMBODIMENTS

The following detailed description refers to the accompanying drawings. The same reference numbers in different drawings may identify the same or similar elements.

Figure 1A:
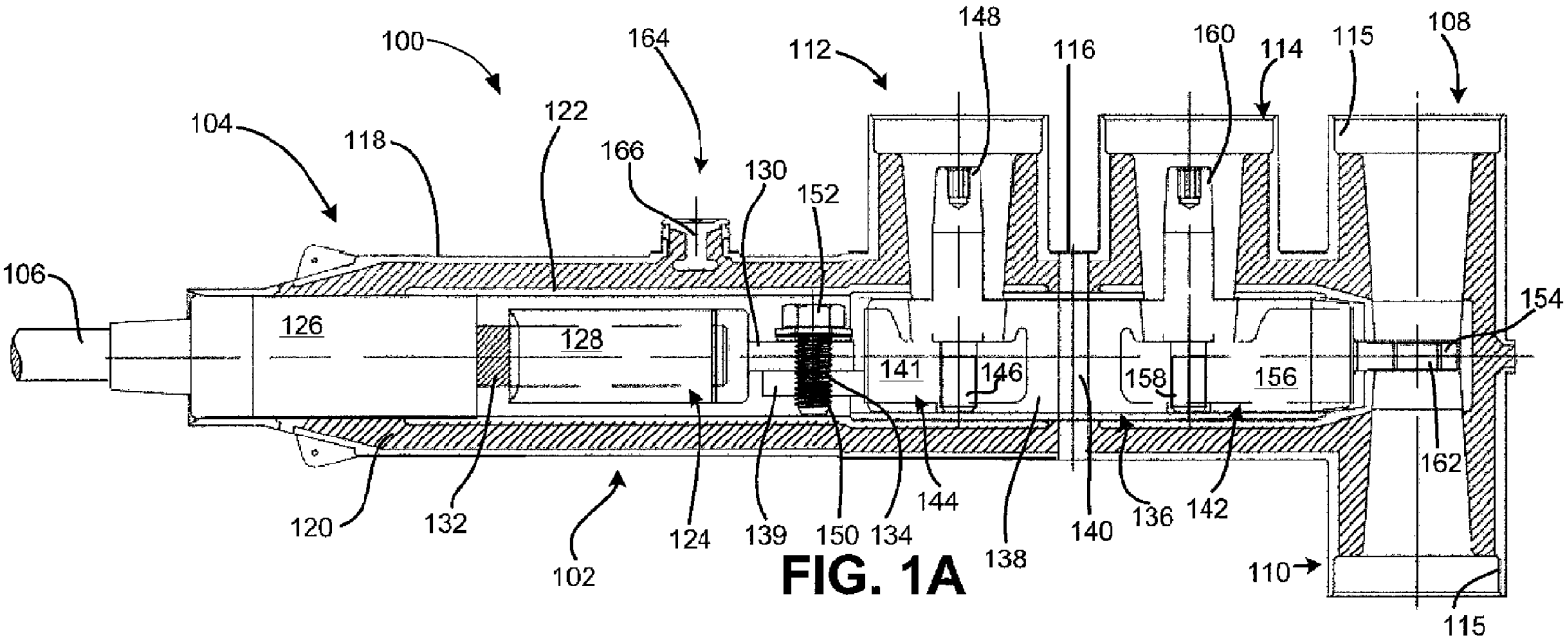
FIG. 1A is a schematic cross-sectional diagram illustrating an electrical connector consistent with implementations described herein.
Figure 1B:
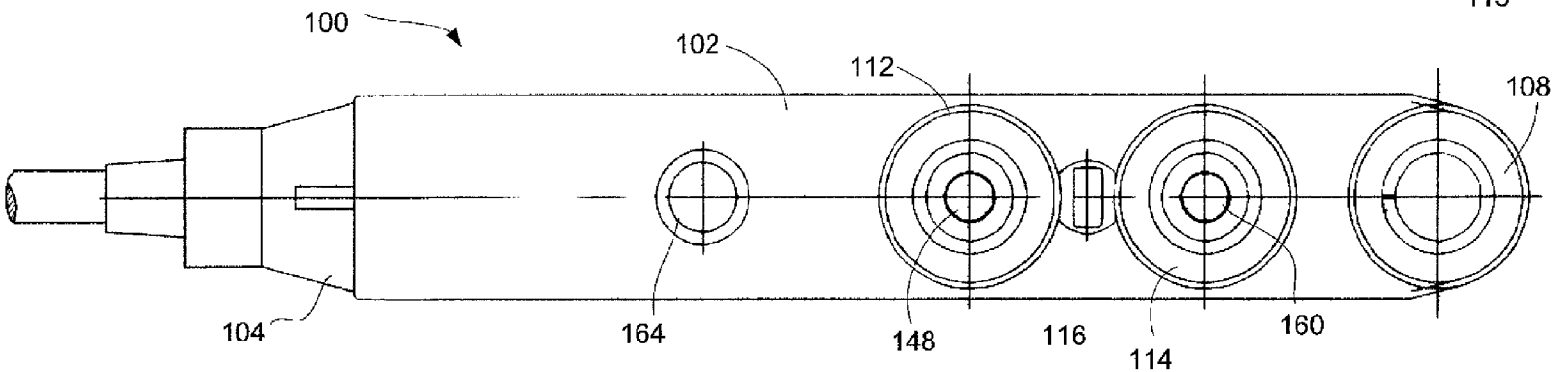
FIG. 1B is a top view diagram of the electrical connector of FIG. 1A.

FIGS. 1A and 1B are a schematic cross-sectional diagram and top view, respectively, illustrating a power cable elbow connector 100 configured in a manner consistent with implementations described herein. As shown in FIG. 1A, power cable elbow connector 100 may include a body portion 102, a conductor receiving end 104 for receiving a power cable 106 therein, first and second T ends 108/110 distal from conductor receiving end 104 and that include openings for receiving a deadbreak transformer bushing or other high or medium voltage terminal, such as an insulating plug, or other power equipment (e.g., a tap, a voltage arrestor, a bushing, etc.), rearward and forward link interface ends 112/114 for receiving a link therein, and a visible open port 116.

Each of first T end 108, second T end 110, rearward link interface end 112, and forward link interface end 114 may include a flange or elbow cuff 115 surrounding the open receiving end thereof. Body portion 102 may extend substantially axially and may include a bore extending therethrough. First and second T ends 108/110 and rearward and forward link interface ends 112/114 may project substantially perpendicularly from body portion 102, as illustrated in FIG. 1A.

Power cable elbow connector 100 may include an electrically conductive outer shield 118 formed from, for example, a conductive or semi-conductive peroxide-cured synthetic rubber, such as EPDM (ethylene-propylene-dienemonomer). Within shield 118, power cable elbow connector 100 may include an insulative inner housing 120, typically molded from an insulative rubber or silicon material. Within insulative inner housing 120, power cable elbow connector 100 may include a conductive or semi-conductive insert 122 that surrounds the connection portion of power cable 106.

Conductor receiving end 104 of power cable elbow connector 100 may be configured to receive power cable 106 therein. As shown in FIG. 1A, a forward end of power cable 106 may be prepared by connecting power cable 106 to a conductor spade assembly 124. As illustrated in FIG. 1A, conductor spade assembly 124 may include a modular configuration. More specifically, conductor spade assembly 124 may include a rearward sealing portion 126, a crimp connector portion 128, and a spade portion 130.

Rearward sealing portion 126 may include an insulative material surrounding a portion of power cable 106 about an opening of conductor receiving end 104. When conductor spade assembly 124 is positioned within conductor receiving end 104, rearward sealing portion 126 may seal an opening of conductor receiving end 104 about power cable 106.

Crimp connector portion 128 may include a substantially cylindrical assembly configured to receive a center conductor 132 of power cable 106 therein. Upon insertion of center conductor 132 therein, crimp connector portion 128 may be crimped onto or otherwise secured to center conductor 132 prior to insertion of power cable 106 into conductor receiving end 104.

Spade portion 130 may be conductively coupled to crimp connector portion 128 and may extend axially therefrom. Spade portion 130 may be have substantially planar upper and lower surfaces and may include a perpendicular bore 134 extending therethrough.

As shown in FIG. 1A, connector 100 may include a link connection body assembly 136 configured to enable conductive coupling of power cable 106 to T ends 108 and 110 when the link is in an engaged or fully inserted state (described below in relation to FIG. 2) and for insulating T-ends 108 and 110 from power cable 106 when the link assembly is either removed or when the link assembly is in a non-engaged state.

In one embodiment, link connection body assembly 136 may include an insulative body 138 formed of, for example, insulative rubber or epoxy material. Insulative body 138 may by sized to fit within insert 122 in connector 100. Consistent with implementations described herein, insulative body 138 in link connection body assembly 136 includes a visible open area 140 aligned with visible open port 116 in connector 100. In one implementation, visible open area 140 and visible open port 116 formed in connector shield 118, insulative inner housing 120, and semi-conductive insert 122, may be formed of a transparent or substantially transparent insulating material, such as glass, plastic, etc. In some implementations, visible open port 116 and/or visible open area 140 of link connection body assembly 136 may be provided in only a portion of connector 100, as shown in FIG. 1B (e.g., as a cylindrical or rectangular window or port through connector 100).

By forming visible open area 140 and visible open port 116 of a transparent material, a technician or worker may be able to visually confirm the break between the source side (e.g., power cable 106) and load side (e.g., T-ends 108/110) in connector 100. In other implementations, visible open area 140 in insulative body 138 may have a different color than shield 118 and/or housing 120, such as green, red, etc. As shown in FIG. 1B, visible open port 116 may be formed as a window or substantially circular opening in outer shield 118 of connector 100. In other implementations, visible open port 116 may be formed as a band about outer shield 118 of connector 100.

A forward link spade assembly 142 and a rearward link spade assembly 144 may be formed within insulative body 138, on opposing sides of visible open area 140. For example, forward link spade assembly 142 and rearward link spade assembly 144 may be embedded into insulative body 138 during molding or formation of insulative body 138. In other implementations, forward link spade assembly 142 and rearward link spade assembly 144 may be installed within insulative body 138 after manufacture of insulative body 138.

Rearward link spade assembly 144 may include a second spade portion 139 and a first conductive body portion 141. First conductive body portion 141 may be received within insulative body 138, may be substantially cylindrical, and may be configured for alignment with rearward link interface end 112 upon installation of link connection body assembly 136 within connector 100.

More specifically, first conductive body portion 141 may include a stud receiving portion 146 for receiving a first conductive stud 148 therein. First conductive stud 148 may provide a conductive interface between rearward link spade assembly 144 and rearward link connector interface bushing (element 204 in FIG. 2). In one implementation, first conductive stud 148 may be substantially cylindrical and may project from rearward link spade assembly 144 into rearward link interface end 112. In one implementation, as shown in FIG. 1B, first conductive stud 148 may extend substantially concentrically within rearward link interface end 112.

Similar to spade portion 130 described above, second spade portion 139 may extend axially from first conductive body portion 141 in a rearward direction (e.g., toward power cable 106). Second spade portion 139 may also have substantially planar upper and lower surfaces and may include a perpendicular bore 150 extending therethrough. As shown in FIG. 1A, the position of second spade portion 139 may be offset with respect to spade portion 130, thereby allowing perpendicular bore 150 in second spade portion 139 to align with perpendicular bore 134 in spade portion 130.

Conductor spade assembly 124 may be securely fastened to rearward link spade assembly, such as via a stud or bolt 152 threaded into bores 134/150 in spade portions 130/138, respectively.

Forward link spade assembly 142 may include a third spade portion 154 and a second conductive body portion 156. Similar to first conductive body portion 141, second conductive body portion 156 may be received within insulative body 138, may be substantially cylindrical, and may be configured for alignment with forward link interface end 114 upon installation of link connection body assembly 136 within connector 100.

More specifically, second conductive body portion 156 may include a stud receiving portion 158 for receiving a second conductive stud 160 therein. Second conductive stud 160 may provide a conductive interface between forward link spade assembly 142 and forward link connector interface bushing (element 206 in FIG. 2). In one implementation, second conductive stud 160 may be substantially cylindrical and may project from forward link spade assembly 142 into forward link interface end 114. In one implementation, as shown in FIG. 1B, second conductive stud 160 may extend substantially concentrically within forward link interface end 114.

Similar to second spade portion 139 described above, third spade portion 154 may extend axially from second conductive body portion 156 in a forward direction (e.g., toward T-ends 108/110). Third spade portion 154 may also have substantially planar upper and lower surfaces and may include a perpendicular bore 162 extending therethrough. As shown in FIG. 1A, third spade portion 154 may project into a space between first T end 108 and second T end 110. Once third spade assembly 154 is properly seated within connector 100, bore 162 may allow a stud or other element associated with first T end 108 to conductively engage spade assembly 154 and/or a device connected to second T end 110.

Forward link spade assembly 142 and rearward link spade assembly 144 may be formed of a conductive material, such as copper, aluminum, or a conductive alloy.

In one exemplary implementation, power cable elbow connector 100 may include a voltage detection test point assembly 164 for sensing a voltage in connector 100. Voltage detection test point assembly 164 may be configured to allow an external voltage detection device, to detect and/or measure a voltage associated with connector 100.

For example, as illustrated in FIG. 1A, voltage detection test point assembly 164 may include a test point terminal 166 embedded in a portion of insulative inner housing 120 and extending through an opening within outer shield 118. In one exemplary embodiment, test point terminal 166 may be formed of a conductive metal or other conductive material. In this manner, test point terminal 166 may be capacitively coupled to the electrical conductor elements (e.g., power cable 106) within the connector 100.

Figure 2B:
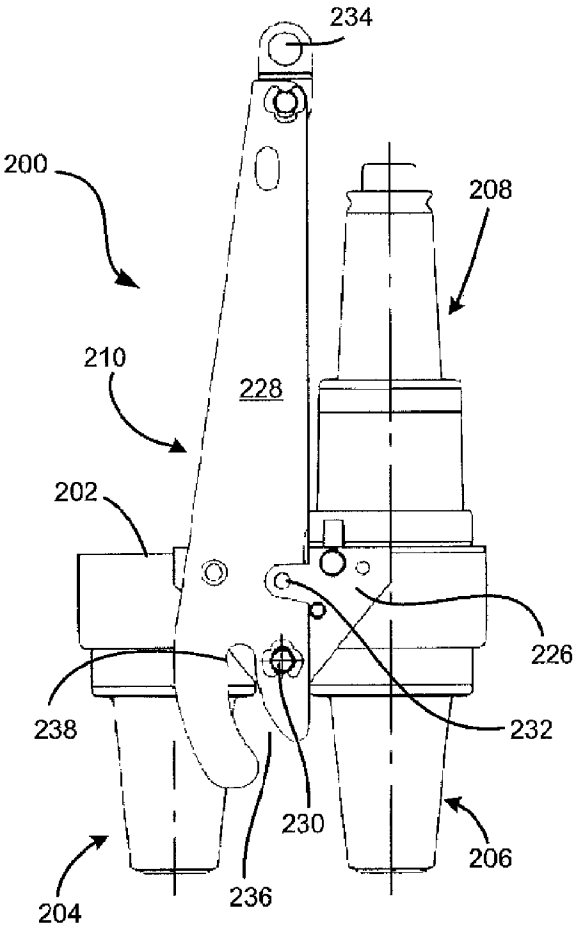
FIG. 2B is a side view of the cam-op link of FIG. 2A.
Figure 2A:
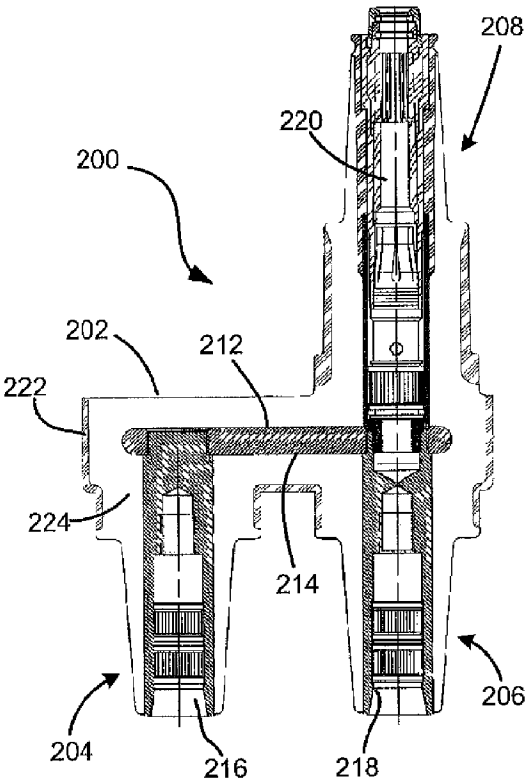
FIG. 2A is a schematic cross-sectional view of an exemplary cam-op link consistent with implementations described herein.

FIGS. 2A and 2B are schematic side and cross-sectional views, respectively, of an exemplary cam-op link 200 consistent with implementations described herein. As shown in FIG. 2A, cam-op link 200 may include link body portion 202, rearward link interface bushing 204, forward link interface bushing 206, loadbreak/deadbreak interface 208, and link engagement assembly 210.

In general, cam-op link 200 may be configured to provide a conductive link between rearward link interface opening 112 and forward link interface opening 114 that may be installed in an efficient and secure manner, as described in detail below. Although a cam-op link embodiment is described herein, it should be understood that other devices may be used in embodiment consistent with implementations described herein. For example, a tie-down link or other interface embodiment may be used without departing from the scope of the described embodiments.

Link body portion 202 may extend substantially axially and may include a bore 212 extending at least partially therethrough. As shown in FIG. 2A, bore 212 may be configured to receive a bus bar 214 therein. Bus bar 214 may be formed of a conductive material, such as copper. Forward and rearward link interface bushings 206/204 may project substantially perpendicularly from link body portion 202 and may include rearward and forward stud receiving buses 216 and 218, respectively. As shown in FIG. 2A, rearward and forward stud receiving buses 216/218 may be conductively coupled to bus bar 214.

Figure 3A:
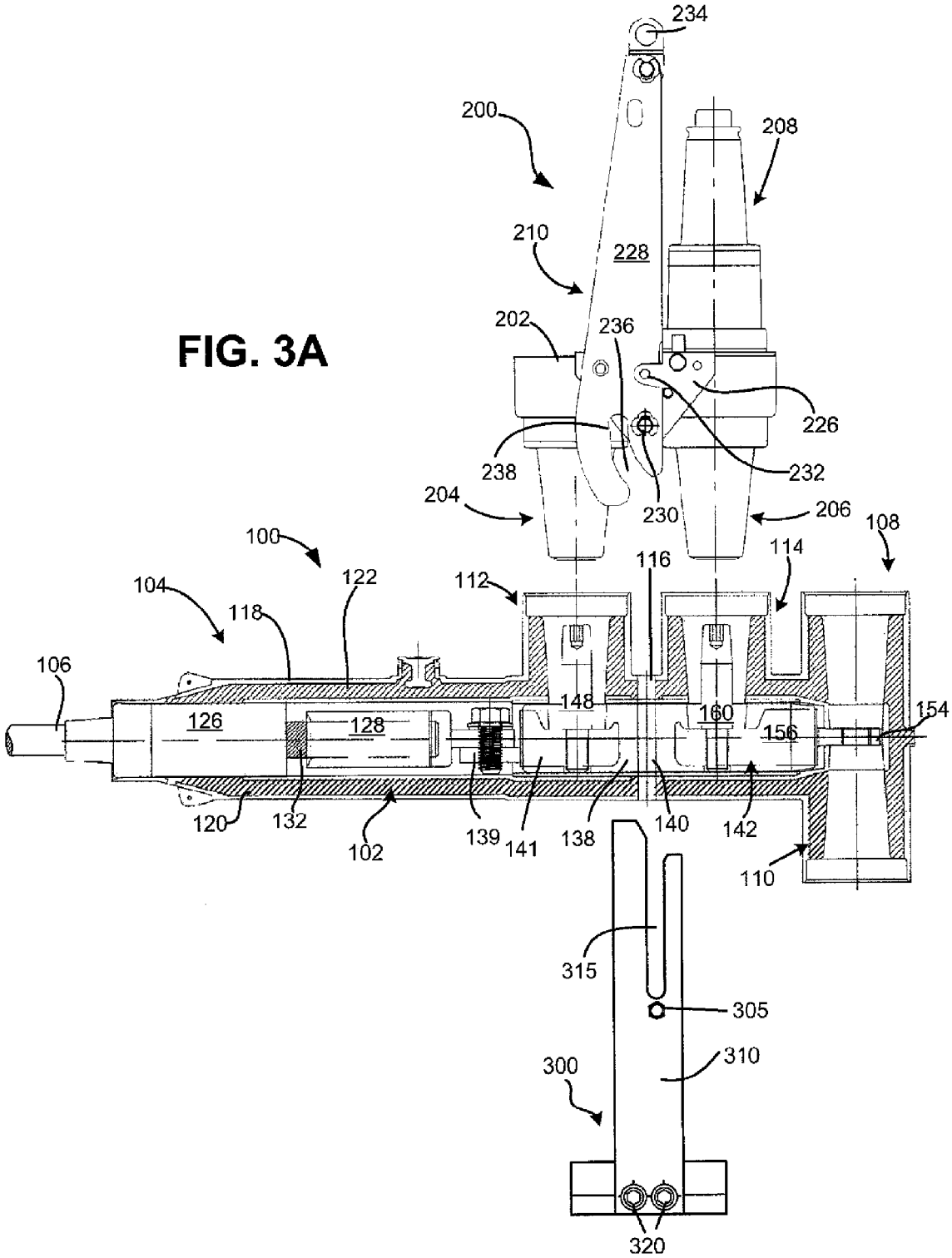
FIG. 3A is a side view of the connector of FIGS. 1A-1B and the cam-op link of FIGS. 2A-2B in an exploded, unassembled configuration.
Figure 3B:
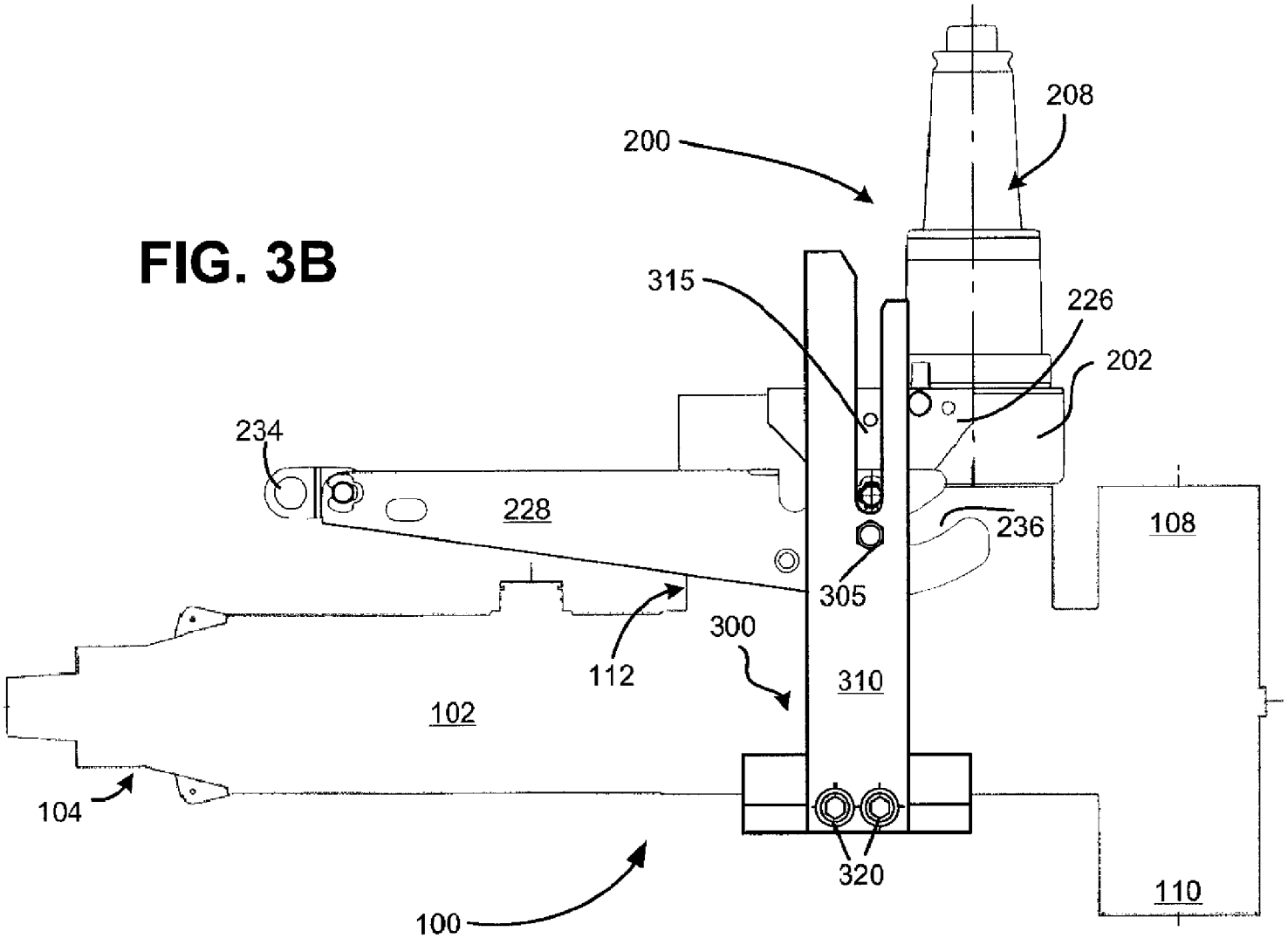
FIG. 3B is a side view of the connector of FIGS. 1A-1B and the cam-op link of FIGS. 2A-2B in an assembled configuration.

Upon installation into connector 100, rearward link interface bushing 204 may be configured to align with (and sized for insertion into) rearward link interface opening 112 and forward link interface bushing 206 may be configured to align with (and sized for insertion into) forward link interface opening 114, as shown in FIGS. 3A and 3B.

Rearward link interface opening 112 and forward link interface bushing 206 may be sized to receive first and second conductive studs 148/160 upon insertion of cam-op link 200 into connector 100. In this manner, power cable 106 may be conductively coupled from rearward link spade assembly 144 to forward link spade assembly 142.

As shown in FIG. 2A, loadbreak/deadbreak interface 208 may include a contact 220 conductively coupled to bus bar 214 and forward stud receiving bus 218. Contact 220 may be formed of a conductive material, such as copper or aluminum. In addition, configuration of cam-op link 200 to include an integrated loadbreak/deadbreak interface 208 may facilitate connection of a second power elbow or other loadbreak/deadbreak equipment (e.g., grounding device, etc.) to connector cam-op link 200.

Cam-op link 200 may include an electrically conductive outer shield 222 formed from, for example, a conductive or semi-conductive peroxide-cured synthetic rubber (e.g., EPDM). In other implementations, at least a portion of cam-op link 200 may be painted with conductive or semi-conductive paint to form shield 222. Within shield 222, cam-op link 200 may include an insulative inner housing 224, typically molded from an insulative rubber or epoxy material.

As shown in FIG. 2B, link engagement assembly 210 may include a link arm bracket 226 and a link arm 228. As described in detail below, link arm bracket 226 may be secured to cam-op link 200 (e.g., via one or more bolts, etc.). Link arm 228 may, in turn, be rotatably secured to link arm bracket 226 via a pivot pin 230. In some implementations, pivot pin 230 may extend from link arm 228 to engage a corresponding slot in a cam-op link bracket connected to elbow connector 100 (element 300 in FIGS. 3A and 3B). This feature is described in additional detail below with respect to FIGS. 3A and 3B. As shown in FIG. 2B, link arm bracket 226 may include a stop 232 for preventing link arm 228 from rotating past a vertical orientation and a hole 234 in an end of link arm 228 distal from pivot pin 230, for enabling engagement of link arm 228 by a suitable tool, such as a hotstick or lineman's tool. Downward movement of the tool may cause link arm 228 to rotate downward about pivot pin 230 toward rearward link interface bushing 204 and forward link interface bushing 206.

Link arm 228 may also include a curved clamp pin engagement slot 236 for engaging a corresponding clamp pin in cam-op link bracket 300 (element 305 in FIGS. 3A and 3B). As described below, rotation of link arm 228 about pivot pin 230 when cam-op link 200 is installed in connector 100 may cause clamp pin engagement slot 236 to slidingly engage clamp pin 305. In one implementation, clamp pin engagement slot 236 may include a pin retaining portion 238. As shown, pin retaining portion 238 may be formed at a terminating end of clamp pin engagement slot 236 and may include a notched portion configured to retain clamp pin 305 in clamp pin engagement slot 236 to prevent undesired rotation of link arm 228.

FIGS. 3A and 3B are an side exploded view in an unassembled configuration and an assembled side view, respectively, of connector 100 and cam-op link 200 according to one exemplary implementation. As described above, assembled elbow connector 100 may include cam-op link bracket 300 for facilitating securing of cam-op link 200 to elbow connector 100. In one implementation, cam-op link bracket 300 may include bracket arms 310 (one of which is seen in FIGS. 3A and 3B) that include pin engagement slots 315 therein. Although not explicitly shown in FIGS. 3A and 3B, opposing sides of bracket 300 (each including a bracket arm 310) may be joined and secured to connector 100 via bolts 320.

During installation, bracket 300 is mounted to elbow connector 100 proximate to rearward and forward link interface ends 112/114. As shown, in this configuration, bracket arms 310 extend upward between rearward and forward link interface ends 112/114 for receiving cam-op link 200 therebetween. Pivot pin 230 in cam-op link 200 may be received within pin engagement slots 315 in bracket arms 310, thereby directing rearward link interface bushing 204 toward rearward link interface opening 112 and forward link interface bushing 206 toward forward link interface opening 114, as shown in FIG. 3B.

Upon initial seating of link interface bushings 204/206 into link interface openings 112/114, link arm 228 may be rotated about pivot pin 230 to lock or secure cam-op link 200 to elbow connector 100. As shown in FIG. 3B, at the initial seating position, an opening of clamp pin engagement slot 236 in link arm 228 may be aligned with clamp pin 305 in cam-op link bracket 300. Upon rotation of link arm 228, clamp pin engagement slot 236 may slidingly engage clamp pin 305. The location and curved nature of clamp pin engagement slot may cause cam-op link 200 to become securely seated within elbow connector 100 by virtue of the engagement between clamp pin 305 and clamp pin engagement slot 236. At the completion of the rotation of link arm 228, clamp pin 305 may be seated within pin retaining portion 238 to prevent unintentional movement of link arm 228 relative to cam-op link bracket 300.

In some implementations (not shown in FIGS. 2A-3B), cam-op link 200 may be configured without bus bar 214 to provide isolation of rearward link interface end 112 from forward link interface end 114. In other words, cam-op link 200 may not conductively couple forward link spade assembly 142 to rearward link spade assembly 144, as described above. Rather, in this implementation, cam-op link 200 may isolate forward link spade assembly 142 from rearward link spade assembly 144, for example, to provide protection for working (e.g., making connections, etc.) on a load side of the connection (e.g., first and second T-ends 108/110). In this implementation, link body portion 202 may include an insulative material therein.

Furthermore, in some embodiments, link body portion 202 may be provided with a visible open port between extending transversely therethrough. As with visible open port 116 in provided in elbow connector 100, visible open port 116 may include a transparent insulative material that enables a worker to visibly confirm that no contact is provided between a line side of cam-op link 200 (e.g., rearward link interface bushing 204) and a load side of cam-op link 200 (e.g., forward link interface bushing 206). In this implementation, the line side and load side of cam-op link 200 may be provided with loadbreak/deadbreak interfaces (similar to interface 208 described above) conductively coupled to rearward and forward stud receiving bus 216/218, respectively. These interfaces may be coupled to grounding devices for further insuring maximum protection for workers.

By providing an effective and safe mechanism for visibly identifying open break in an electrical connector without requiring removal of switchgear components, various personnel may be more easily able to safely identify and confirm a de-energized condition in a switchgear assembly. More specifically, consistent with aspects described herein, personnel may be able to view a physical open break, and not merely an indicator of an open status, thereby more fully ensuring the personnel that the equipment is, in fact, de-energized. Furthermore, by providing the visible open on an elbow connector connected to the switchgear, existing or legacy switchgear may be easily retrofitted and the entire system may maintain a ground connection throughout operation.

The foregoing description of exemplary implementations provides illustration and description, but is not intended to be exhaustive or to limit the embodiments described herein to the precise form disclosed. Modifications and variations are possible in light of the above teachings or may be acquired from practice of the embodiments. For example, implementations may also be used for other devices, such as other medium or high voltage switchgear equipment, such as any 15 kV, 25 kV, 35 kV, etc., equipment, including both deadbreak-class and loadbreak-class equipment.

For example, various features have been mainly described above with respect to elbow power connectors. In other implementations, other medium/high voltage power components may be configured to include the visible open port configuration described above.

Although the invention has been described in detail above, it is expressly understood that it will be apparent to persons skilled in the relevant art that the invention may be modified without departing from the spirit of the invention. Various changes of form, design, or arrangement may be made to the invention without departing from the spirit and scope of the invention. Therefore, the above-mentioned description is to be considered exemplary, rather than limiting, and the true scope of the invention is that defined in the following claims.

No element, act, or instruction used in the description of the present application should be construed as critical or essential to the invention unless explicitly described as such. Also, as used herein, the article "a" is intended to include one or more items. Further, the phrase "based on" is intended to mean "based, at least in part, on" unless explicitly stated otherwise.

What is claimed is:

1. An electrical connector assembly, comprising:

a connector body having a conductor receiving end, a first link interface, a second link interface, a first connector end, and a visible open port between the first link interface and the second link interface;

wherein the first link interface is conductively coupled to a conductor received within the conductor receiving end;

wherein the second link interface is spaced axially from the first link interface and is conductively coupled to the first connector end;

wherein the first link interface and the second link interface are configured to receive a link assembly therein to electrically couple the first link interface to the second link interface;

an insulative material positioned within the connector body axially between the first link interface and the second link interface; and wherein at least a portion of the insulative material is visible through the visible open port.

2. The electrical connector assembly of claim 1, wherein the connector body is substantially cylindrical and comprises a conductive insert, an insulative inner housing, and an outer shield.

3. The electrical connector assembly of claim 1, wherein the insulative material comprises a transparent material.

4. The electrical connector assembly of claim 1, wherein the link assembly comprises a cam-op link.

5. The electrical connector assembly of claim 1, wherein the connector body comprises an outer housing; and wherein the visible open port comprises a transparent portion of the outer housing.

6. The electrical connector assembly of claim 1, further comprising:

a link bracket coupled to the connector body for securing the link to the connector body, wherein the link comprises a body portion and first and second bushing ends for insertion into the first and second link interfaces, respectively.

7. The electrical connector assembly of claim 6, wherein the first and second bushing ends comprise first and second buses, respectively, for conductively communicating with the first and second link interfaces, respectively, in the connector body upon insertion of the link into the connector body;

wherein the link body portion comprises link insulative material between the first and second buses; and wherein an outer surface of the link body portion comprises a visible open port proximate the link insulative material.

8. The connector assembly of claim 7, wherein the visible open port comprises a transparent or substantially transparent material.

9. The connector assembly of claim 7, wherein the link insulative material comprises a transparent or substantially transparent material.

10. The connector assembly of claim 1, wherein the first connector end comprises an interface for receiving a grounding device, a plug, a bushing, a tap, or a voltage arrestor.

11. The connector assembly of claim 1, further comprising a second connector end opposite from the first connector end.

12. The connector assembly of claim 1, wherein the connector body comprises a power cable elbow.

13. A system, comprising:

a connector body having an axial bore therethrough, wherein the connector body comprises:

a conductor receiving end for receiving a cable;

a first connector end projecting substantially perpendicularly from the connector body at an end distal from the conductor receiving end;

a first link interface projecting perpendicularly from the connector body at a first intermediate position, wherein the first link interface is conductively coupled to the cable;

a second link interface projecting perpendicularly from the connector body at a second intermediate position spaced from the first intermediate position, wherein the first link interface and the second link interface are configured to receive a cam-op link therein; and a viewing port positioned on the connector body between the first link interface and the second link interface; and a link connection body assembly positioned within the connector body proximate the first link interface, the second link interface, and the viewing port.

14. The system of claim 13, wherein the link connection body assembly comprises:

a first conductive interface aligned with the first link interface in the connector body;

a second conductive interface aligned with the second link interface in the connector body; and an insulative material formed between the first conductive interface and the second conductive interface.

15. The system of claim 14, wherein the insulative material comprises a substantially transparent material.

16. The system of claim 14, wherein the first and second conductive interfaces comprise conductive studs projecting from the link connection body assembly with the first and second link interface, respectively.

17. The system of claim 13, comprising:

a link bracket coupled to the connector body; and a link assembly comprising a body portion and first and second bushing interfaces extending from the body portion, wherein the first and second bushing interfaces are configured to engage the first and second link interfaces, respectively, in the connector body.

18. The system of claim 17, wherein the link assembly comprises a cam-op link having a link arm moveable to secure the cam-op link to the link bracket and the connector body.

19. The system of claim 17, wherein the first and second bushing interfaces comprise first and second buses for conductively connecting to the first and second conductive interfaces, respectively, in the connector body;

wherein the link body portion comprises link insulative material between the first and second buses; and wherein an outer surface of the link body portion comprises a visible open port proximate the link insulative material.

20. The system of claim 17, wherein the first connector end comprises an interface for receiving a grounding device, a plug, a bushing, a tap, or a voltage arrestor.

* * * * *